US011425974B2

(12) United States Patent
Liu et al.

(10) Patent No.: US 11,425,974 B2
(45) Date of Patent: Aug. 30, 2022

(54) RING ADJUSTER

(71) Applicants: Yuhui Liu, Shenzhen (CN); Tianshu Zhang, Shenzhen (CN)

(72) Inventors: Yuhui Liu, Shenzhen (CN); Tianshu Zhang, Shenzhen (CN)

( * ) Notice: Subject to any disclaimer, the term of this patent is extended or adjusted under 35 U.S.C. 154(b) by 0 days.

(21) Appl. No.: 17/023,303

(22) Filed: Sep. 16, 2020

(65) Prior Publication Data

US 2022/0079305 A1 Mar. 17, 2022

(51) Int. Cl.
*A44C 9/02* (2006.01)

(52) U.S. Cl.
CPC ..... *A44C 9/02* (2013.01)

(58) Field of Classification Search
CPC ..... A44C 9/02
USPC ..... 63/15.5, 15.6, 15.65
See application file for complete search history.

(56) References Cited

U.S. PATENT DOCUMENTS 1,754,392 A * 4/1930 Levin ..... A44C 9/02 63/15.6
1,858,861 A * 5/1932 Levin ..... A44C 9/02 63/15.6
1,864,447 A * 6/1932 Lev ..... A44C 9/00 63/15.6
3,028,736 A * 4/1962 Kahre ..... A44C 9/02 63/15.2
3,238,741 A * 3/1966 Johnson ..... A44C 9/02 63/15.6
3,552,144 A * 1/1971 Cormier ..... A44C 9/02 63/15.6
5,239,842 A * 8/1993 Gesensway ..... A44C 9/02 63/15.6
5,628,208 A * 5/1997 Rood ..... A44C 9/02 63/15.5
2008/0314082 A1* 12/2008 Nanasi ..... A44C 9/02 63/15.6

* cited by examiner

*Primary Examiner* — Jack W Lavinder

(57) ABSTRACT

The present disclosure provides a ring adjuster. The ring adjuster includes an adjuster main body, at least one locking structure, a first side wall and a second side wall. The adjuster main body is arc-shaped, the first side wall and the second side wall are connected with two opposite sides of the adjuster main body respectively. The adjuster main body includes an inner surface and an outer surface, the inner surface is configured to contact with a user's finger, the outer surface is configured to contact with a ring. The locking structure crosses the first side wall and the second side wall such that a locking chamber is formed between the outer surface and the locking structure to contain the ring.

7 Claims, 5 Drawing Sheets

RING ADJUSTER

FIELD OF THE INVENTION

The present invention relates to the field of jewelry accessories, and specifically to a ring adjuster.

BACKGROUND OF THE INVENTION

It is difficult to determine a user's ring size because the ring size changes over time. Although a user's specific ring size is measured during purchasing a ring on a specific date, a variety of factors ultimately affect the use's actual ring size someday. Various physiological conditions are known to affect the ring size. For example, the user's finger may expand due to hormonal changes or water retention. Other factors may aggravate water retention, such as high salt intake during the user's diet. In addition, weight gain and weight loss can also affect the user's ring size. Therefore, it is usually difficult to put a ring with appropriate size on a user's joint, especially when the finger joint is smaller, the relative size of the ring is larger. When the user's wears the ring, due to the larger size of the ring, the ring is easy to lose and slip, resulting in the lose of the ring, which brings great property loss and great spiritual harm to the user because great meaningful of the ring.

Currently, the common solution to adjust the ring size is to go to the jeweler and readjust the ring size. Although this method is usually very useful for infrequent and small size adjustment, it is relatively expensive and time-consuming. It is impractical to use this method to solve the daily change of ring size for most users.

Another adjustment solution is to set a ring adjuster on the ring to reduce the inner diameter of the ring. However, the current ring adjuster \mostly set a simple barb to clamp the ring to connect the ring and the ring adjuster together. This method is to fix the ring by the pressure difference between the outer diameter of the finger and the inner diameter of the ring. However, by use of this simple barb design, if the pressure difference is small, the connection between the ring and the ring adjuster may be not tight, which not only makes the ring easy to move in the ring adjuster, but also the ring adjuster is easy to separate from the ring, resulting in the lose of the ring. If the pressure difference is too big, it will make the user's finger be compressed, resulting in the blood flow of the finger.

Another solution is to apply a chemical adhesive film to the inside surface of the ring. The disadvantage of this solution is that the chemical adhesive film is easy to bring skin allergy of users, and the chemical adhesive film also reacts with the metal of the ring, causing the ring to change color and affecting the surface smoothness of the ring.

SUMMARY OF THE INVENTION

In order to overcome the disadvantage of the existing ring adjusters, the present disclosure provides a ring adjuster having magnets inside to form universal magnetic connection between the blocks, which has a good user experience and reasonable design.

The present disclosure adopts the following technical solution: a ring adjuster including an adjuster main body, at least one locking structure, a first side wall and a second side wall, the adjuster main body being arc-shaped, the first side wall and the second side wall connected with two opposite sides of the adjuster main body respectively, the adjuster main body including an inner surface and an outer surface, the inner surface configured to contact with a user's finger, the outer surface configured to contact with a ring, the locking structure crossing the first side wall and the second side wall such that a locking chamber is formed between the outer surface and the locking structure to contain the ring.

Further, the locking structure includes a locking belt, the second side wall includes a locking inlet, a rear end of the locking belt connects with the first side wall, and a front end of the locking belt passes through the locking inlet from an outside of the second side wall so as to be locked into the locking inlet.

Further, the front end of the locking belt includes a plurality of locking teeth, a width of each locking tooth is larger than a width of the locking inlet, when the locking tooth passes through the locking inlet, an inner surface of the locking inlet compresses a side surface of the locking tooth, such the lock tooth is locked in the locking inlet.

Further, the plurality of the locking teeth are arranged along a length direction of the locking belt, the outer surface of the adjuster main body includes a first locking groove and a second locking groove communicated with the first locking groove, a width of the first locking groove is less than a width of the second locking groove, such that a step surface is formed between the first locking groove and second locking groove, and a width of the locking tooth is greater than the width of the first locking groove.

Further, the locking tooth is in a triangle shape with a narrow front part and a wide rear part and includes a guiding inclined surface located in front side and a locking end surface located in rear side.

Further, the outer surface of the adjuster main body depresses to form the first locking groove and the second locking groove, both of a vertical height of the first locking groove and a vertical height of the second locking groove are greater than or equal to a vertical height of the locking belt.

Further, the first side wall includes an adjusting outlet communicated with the second locking groove.

Further, the front end of the locking belt connects with a guiding portion, and a width of a rear end of the guiding portion is greater than a width of a front end of the guiding portion.

Further, the adjuster main body, the locking structure, the first side wall and the second side wall are made of of flexible material, the rear end of the locking belt and the first side wall are molded in one piece, and the locking teeth and the front end of the locking belt are molded in one piece.

Further, the at least one locking structure comprises at least two locking structures, and the at least two locking structures are arranged along a length direction of the adjuster main body.

The present disclosure also adopts the following technical solution: a ring adjuster including: an adjuster main body, the adjuster main body being arc-shaped and including an inner surface and an outer surface, the inner surface configured to contact with a user's finger, the outer surface configured to contact with a ring; a first side wall connected with one side of the adjuster main body; a second side wall connected with the other side of the adjuster main body and facing the first side wall; and at least one locking structure, the locking structure crossing the first side wall and the second side wall such that a locking chamber is formed between the outer surface and the locking structure to contain the ring.

Further, the locking structure includes a locking belt, the second side wall includes a locking inlet, a rear end of the locking belt connects with the first side wall, and a front end of the locking belt passes through the locking inlet from an outside of the second side wall so as to be locked into the locking inlet.

Further, the front end of the locking belt includes a plurality of locking teeth, a width of each locking tooth is larger than a width of the locking inlet, when the locking tooth passes through the locking inlet, an inner surface of the locking inlet compresses a side surface of the locking tooth, such the lock tooth is locked in the locking inlet.

Further, the plurality of the locking teeth are arranged along a length direction of the locking belt, the outer surface of the adjuster main body includes a first locking groove and a second locking groove communicated with the first locking groove, a width of the first locking groove is less than a width of the second locking groove, such that a step surface is formed between the first locking groove and second locking groove, and a width of the locking tooth is greater than the width of the first locking groove.

Further, the locking tooth is in a triangle shape with a narrow front part and a wide rear part and includes a guiding inclined surface located on the front part and a locking end surface located on the rear part.

Further, the locking teeth are symmetrically distributed on two opposite sides of the locking belt.

Further, the first side wall includes an adjusting outlet communicated with the second locking groove.

Further, the front end of the locking belt connects with a guiding portion, and a width of a rear end of the guiding portion is greater than a width of a front end of the guiding portion.

Further, the adjuster main body, the locking structure, the first side wall and the second side wall are made of of flexible material, the rear end of the locking belt and the first side wall are molded in one piece, and the locking teeth and the front end of the locking belt are molded in one piece.

Further, the ring adjuster further includes another locking structure, and another locking structure crosses the first side wall and the second side wall such that the locking chamber is formed between the outer surface and the two locking structures to contain the ring.

The present disclosure also has the beneficial effects: through the the above structure, since the adjuster main body has the first side wall and the second side wall, the locking structure crosses the first side wall and the second side wall, such that the locking chamber is formed between the locking structure and the outer surface for containing the ring, and the ring can be tightly locked in the locking chamber, and it is not easy to move and fall off. Furthermore, due to the outer surface of the adjuster main body contacts with the ring and the inner surface of the adjuster main body contacts with the finger, such that the adjuster main body can compensate the size difference between the ring and the user's finger, and the ring can be tightly putted on the user's finger, which can effectively prevent the ring from falling off, loosening and sliding on the user's finger, thus the loss of property and spiritual damages can be avoid.

BRIEF DESCRIPTION OF THE DRAWINGS

For the purpose of a clearer description of the embodiments in this application or technical solutions in prior art, below is a brief introduction of the attached drawings needed to be used in the description of the embodiments or prior art. Apparently, the attached drawings in the following description are only some embodiments indicated in the present application. For ordinary skill in the art, they may obtain other drawings according to these attached drawings without any innovative laboring.

The present disclosure will be further described with reference to the attached drawings and the embodiments hereunder.

DETAILED DESCRIPTION OF THE ILLUSTRATED EMBODIMENTS

In order to provide a clear understanding of the objects, features, and advantages of the embodiments, the following are detailed and complete descriptions to the technological solutions adopted in the embodiments. Obviously, the descriptions are part of the whole embodiments. The other embodiments which are not processed creatively by technicians of ordinary skills in the field are under the protection of this disclosure. The same is given with reference to the drawings and specific embodiments. It should be noted that non-conflicting embodiments in the disclosure and the features in the embodiments may be combined with each other without conflict.

In the following description, numerous specific details are set forth in order to provide a full understanding of the disclosure. The disclosure may be practiced otherwise than as described herein. The following specific embodiments are not to limit the scope of the disclosure.

Unless defined otherwise, all technical and scientific terms herein have the same meaning as used in the field of the art as generally understood. The terms used in the disclosure are to describe particular embodiments and are not intended to limit the disclosure.

The disclosure, referencing the accompanying drawings, is illustrated by way of examples and not by way of limitation. It should be noted that references to "an" or "one" embodiment in this disclosure are not necessarily to the same embodiment, and such references mean "at least one."

First Embodiment

Figure 1:
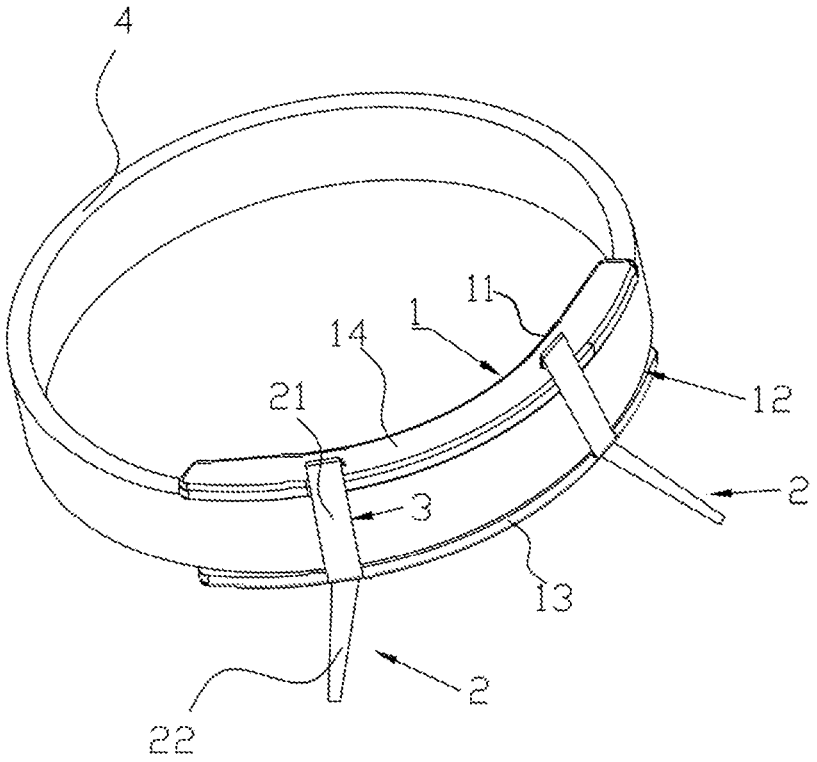
FIG. 1 is a schematic diagram of a ring adjuster installed on a ring according to one embodiment of the present disclosure.
Figure 2:
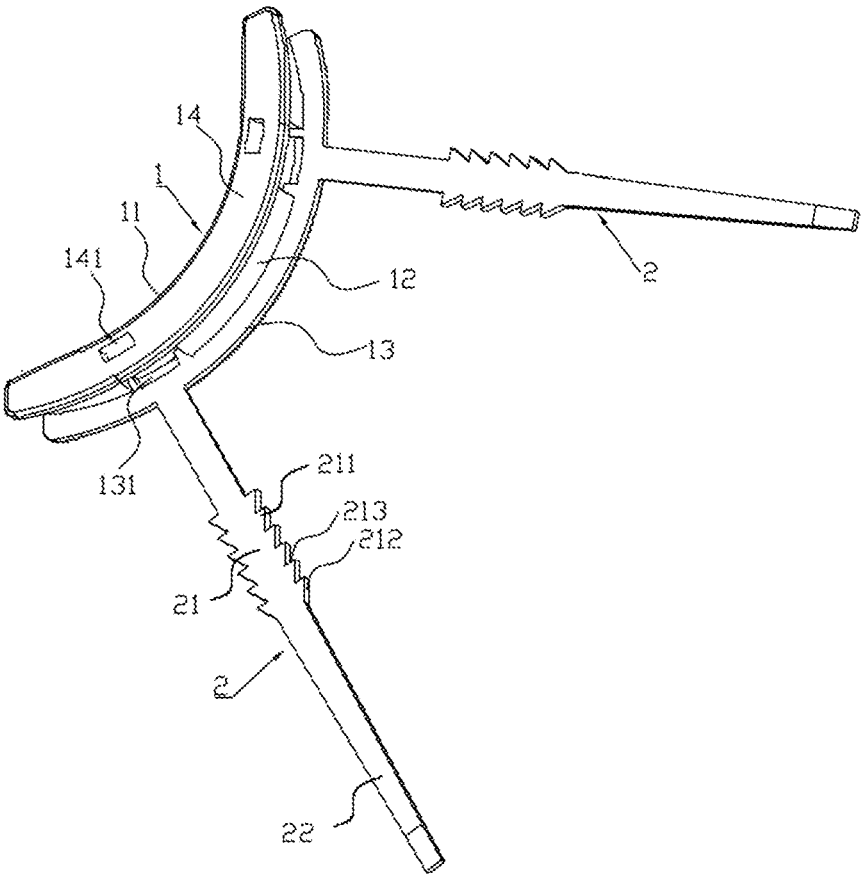
FIG. 2 is a schematic diagram of the ring adjuster of FIG. 1.
Figure 3:
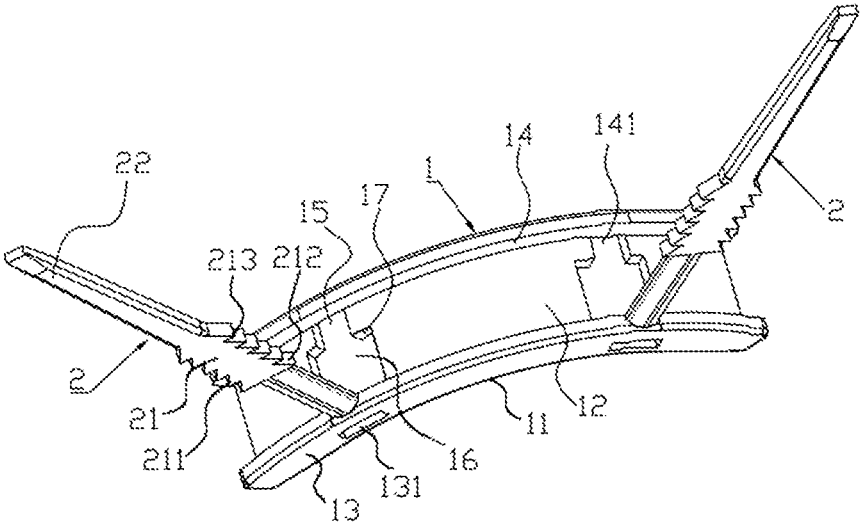
FIG. 3 is another schematic diagram of the ring adjuster of FIG. 1.
Figure 4:
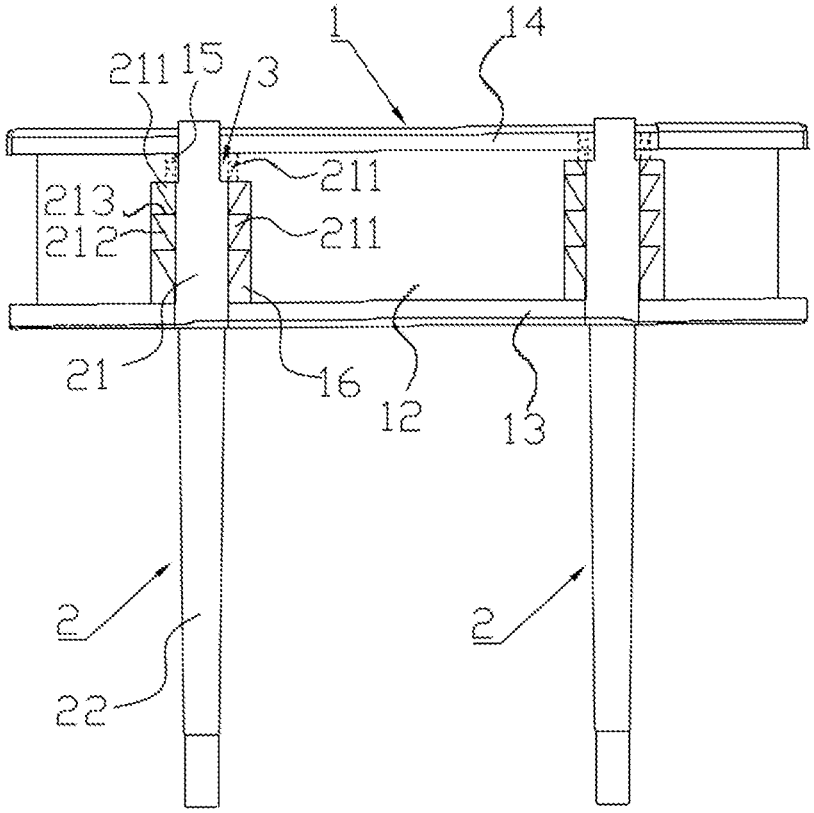
FIG. 4 is a section view of the ring adjuster of FIG. 1.
Figure 5:
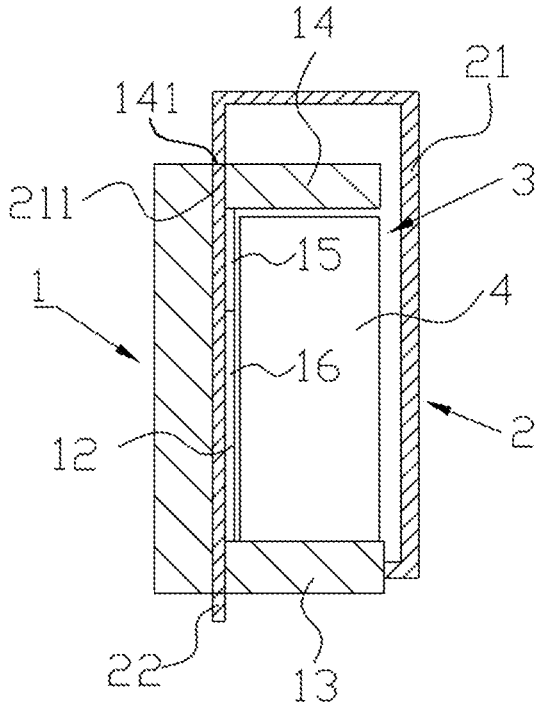
FIG. 5 is another section view of the ring adjuster of FIG. 1.

Referring to FIG. 1-FIG. 5, a ring adjuster includes an adjuster main body 1, two locking structures 2, a first side wall 13 and a second side wall 14. The adjuster main body 1 is arc-shaped, the first side wall 13 and the second side wall 14 are connected with two opposite sides of the adjuster main body 1 respectively. The adjuster main body 1 includes an inner surface 11 and an outer surface 12, the inner surface 11 is configured to contact with a user's finger, the outer surface 12 is configured to contact with a ring 4. The locking structure 2 crosses the first side wall 13 and the second side wall 14 such that a locking chamber 3 is formed between the outer surface 12 and the locking structure 2 to contain the ring 4.

Through the above structure, since the adjuster main body 1 has the first side wall 13 and the second side wall 14, the locking structure 2 crosses the first side wall 13 and the second side wall 14, such that the locking chamber 3 for containing the ring 4 is formed between the locking structure 2 and the outer surface 12, and the ring 4 can be tightly locked in the locking chamber 3, and it is not easy to move and fall off. Furthermore, due to the outer surface 12 of the adjuster main body 1 contacts with the ring 4 and the inner surface 11 of the adjuster main body 1 contacts with the finger, such that the adjuster main body 1 can compensate the size difference between the ring 4 and the user's finger, and the ring 4 can be tightly sheathed on the user's finger, which can effectively prevent the ring 4 from falling off, loosening and sliding on the user's finger, thus the loss of property and spiritual damages can be avoid.

Second Embodiment

Referring to FIG. 1-FIG. 5, a ring adjuster includes an adjuster main body 1, two locking structures 2, a first side wall 13 and a second side wall 14. The adjuster main body 1 is arc-shaped, the first side wall 13 and the second side wall 14 are connected with two opposite sides of the adjuster main body 1 respectively. The adjuster main body 1 includes an inner surface 11 and an outer surface 12, the inner surface 11 is configured to contact with a user's finger, and the outer surface 12 is configured to contact with a ring 4. The locking structure 2 crosses the first side wall 13 and the second side wall 14 such that a locking chamber 3 is formed between the outer surface 12 and the locking structure 2 to contain the ring 4.

Through the above structure, since the adjuster main body 1 has the first side wall 13 and the second side wall 14, the locking structure 2 crosses the first side wall 13 and the second side wall 14, such that the locking chamber 3 for containing the ring 4 is formed between the locking structure 2 and the outer surface 12, and the ring 4 can be tightly locked in the locking chamber 3, and it is not easy to move and fall off. Furthermore, due to the outer surface 12 of the adjuster main body 1 contacts with the ring 4 and the inner surface 11 of the adjuster main body 1 contacts with the finger, such that the adjuster main body 1 can compensate the size difference between the ring 4 and the user's finger, and the ring 4 can be tightly sheathed on the user's finger, which can effectively prevent the ring 4 from falling off, loosening and sliding on the user's finger, thus the loss of property and spiritual damages can be avoid.

In the embodiment, the locking structure 2 includes a locking belt 21, the second side wall 14 includes a locking inlet 141, a rear end of the locking belt 21 connects with the first side wall 13, and a front end of the locking belt 21 passes through the locking inlet 141 from an outside of the second side wall 14 so as to be locked into the locking inlet 141. Through the above structure, the locking structure 2 crosses the the first side wall 13 and the second side wall 14 so as to form the locking chamber between the outer surface 12 and the locking structure 2 to contain the ring 4.

The front end of the locking belt 21 includes a plurality of locking teeth 211, a width of each locking tooth 211 is larger than a width of the locking inlet 141, when the locking tooth 211 passes through the locking inlet 141, an inner surface of the locking inlet 141 compresses a side surface of the locking tooth 211, such the lock tooth 211 is locked in the locking inlet 141. Through the above structure, due to the inner surface of the locking inlet 141 compresses the side surface of the locking tooth 211, such the lock tooth 211 is locked in the locking inlet 141 so as to avoid the locking belt 21 falling off from the locking inlet 141 and achieve a first stage fastening.

In detail, the plurality of the locking teeth 211 are arranged along a length direction of the locking belt 21. The outer surface of the adjuster main body 1 includes a first locking groove 15 and a second locking groove 16 communicated with the first locking groove 15, a width of the first locking groove 15 is less than a width of the second locking groove 16, such that a step surface 17 is formed between the first locking groove 15 and second locking groove, 16 and a width of the locking tooth 211 is greater than the width of the first locking groove 15.

Further, the front locking tooth 211 passes through the second locking groove 16, the rear locking tooth 211 is compressed in the first locking groove 15, the front locking tooth 211 contacts the step surface 17 so as to avoid the locking belt 21 falling off from the second locking groove 16 and achieve a second stage fastening of the locking belt 21.

Furthermore, a width of the second locking groove 16 is greater than the width of the locking tooth 211, such that the front locking tooth 211 is not compressed by the second locking groove 16 and can stretch out, and the front locking tooth 211 contacts the step surface 17.

In the embodiment, the locking tooth 211 is in a triangle shape with a narrow front part and a wide rear part and includes a guiding inclined surface 212 located on the front part and a locking end surface 213 located on the rear part.

The locking teeth 211 can be symmetrically distributed on the left and right sides of the locking belt 21, and it can also be symmetrically distributed on the inside and outside sides of the locking belt 21, and it can be set only on any side of the locking belt 21. Through the above structure, because the locking teeth 211 are triangle shape with the narrow front part and the wide rear part and the locking teeth 211 have the guiding inclined surface 212, the locking teeth 211 can smoothly penetrate into the locking inlet 141. Furthermore, the locking end surface 213 can effectively prevent the locking belt 21 falling out from the locking inlet 141.

In the embodiment, the outer surface 12 of the adjuster main body 1 depresses to form the first locking groove 15 and the second locking groove 16, and both of a vertical height of the first locking groove 15 and a vertical height of the second locking groove 16 are greater than or equal to a vertical height of the locking belt 21.

A top part of the first locking groove 15 is flush with a bottom part of the locking inlet 141, and the width of the first locking groove 15 is greater than or equal to the width of the locking inlet 141. Through the above structure, when the ring adjuster is in use, the locking belt 21 penetrating into the locking grooves 15 and 16 can be fully contained, and will not protrude out to affect the fitting and assembly of the outer surface 12 and the ring 4, so as to make the ring 4 and the outer surface 12 fit tightly.

In the embodiment, the first side wall 13 includes an adjusting outlet 131 communicated with the second locking groove 16. Through the above structure, the front end of the locking belt 21 can pass through the adjusting outlet 131, which can realize more size adjustment.

A top part of the first locking groove 15 is flush with the second locking groove 16, the width of the second locking groove 16 is less than or equal to a width of the adjusting outlet 131. Through the above structure, the appearance of the regulator body 1 is smooth, and there is no interference when the outer surface 12 fits with the ring 4, so that the outer surface 12 and the ring 4 can be tightly fitted.

In the embodiment, the front end of the locking belt 21 connects with a guiding portion 22, and a width of a rear end of the guiding portion 22 is greater than a width of a front end of the guiding portion 22. Through the above structure, it is easy to make the locking belt pass through the locking inlet 141.

In the embodiment, the adjuster main body 1, the locking structure 2, the first side wall 13 and the second side wall 14 are made of flexible material, the rear end of the locking belt 21 and the first side wall 13 are molded in one piece, and the locking teeth 211 and the front end of the locking belt 21 are molded in one piece.

Through the above structure, the overall appearance of the ring adjuster is smooth due to the integrated molding of the locking belt 21 and the adjuster main body 1. Further, the production process is reduced, the production efficiency is improved and the production cost is reduced. Furthermore, because the adjuster main body 1, the locking structure 2, the first side wall 13 and the second side wall 14 are made of of flexible material, the locking tooth 211 of the locking belt 21 can penetrate into the locking inlet 141, and the inner surface of the locking inlet 141 is compressed and locked on a side wall of the locking belt 21.

In the embodiment, the ring adjuster includes two locking structures 2, and the two locking structures 2 are arranged along a length direction of the adjuster main body 1. Through the above structure, due to the two locking structures 2, the ring adjuster can better lock the ring 4 and prevent the ring 4 from shifting.

In the embodiment, both the adjuster main body 1 and the locking belt 2 are made of transparent silicone. Due to the good flexibility of the silicone, a precision compensation can be provided, the outer surface 12 of the adjuster main body 1 can better fit the ring 4. Furthermore, because the adjuster main body 1 and the locking belt 4 are transparent, the overall appearance of the ring 4 will not be shield after the ring 4 is matched with the ring adjuster, which improves the user experience.

Finally, it should be noted that above embodiments are merely used for illustrating the technical solutions of the disclosure, rather than limiting the disclosure; though the disclosure is illustrated in detail with reference to the aforementioned embodiments, it should be understood by those of ordinary skill in the art that modifications may still be made on the technical solutions disclosed in the aforementioned respective embodiments, or equivalent substitutions may be made to a part of technical features thereof; and these modifications or substitutions do not make the essence of the corresponding technical solutions depart from the spirit and scope of the technical solutions of the respective embodiments of the disclosure.

What is claimed and Desired to be Protected by Letters Patent is:

1. A ring adjuster for mounting upon a ring so as to effectively adjust the size of the ring, comprising:

a main body having an arcuate configuration, an inner surface portion adapted to engage a finger of a person wearing the ring, an outer surface portion adapted to engage an outer surface portion of the ring, an upper surface portion connected to upper surface portions of said inner surface portion and said outer surface portion, a lower surface portion connected to lower surface portions of said inner surface portion and said outer surface portion, and a locking inlet defined within said upper surface portion of said main body;

at least one locking belt having a first end integrally fixed to said lower surface portion of said main body and having a second opposite free end portion thereof adapted to pass through said at least one locking inlet defined within said upper surface portion of said main body such that said main body of said ring adjuster is fixedly secured upon the ring after said second opposite free end portion of said at least one locking belt has passed through said locking inlet defined within said upper surface portion of said main body, wherein said at least one locking belt is fabricated from a flexible material; and said second opposite free end of said at least one locking belt comprises at least one locking tooth wherein said at least one locking tooth has a width dimension larger than a width dimension of said locking inlet such that when said at least one locking tooth passes through said locking inlet, said at least one locking tooth will be compressed and will regain its original width dimension, due to said at least one locking belt being fabricated from a flexible material, after said at least one locking tooth has passed through said locking inlet, so as to fixedly secure said ring adjuster upon the ring.

2. The ring adjuster according to claim 1, wherein:

said at least one locking tooth comprises a plurality of locking teeth are arranged along a length direction of said at least one locking belt; and wherein said outer surface portion of said adjuster main body comprises a first locking groove, and a second locking groove in communication with said first locking groove, a width dimension of said first locking groove being less than a width dimension of said second locking groove such that a stepped portion is formed between said first locking groove and said second locking groove, and said width dimension of said locking tooth is greater than said width dimension of said first locking groove such that at least one of said plurality of locking teeth will be locked within said stepped portion.

3. The ring adjuster according to claim 2, wherein:

each locking tooth of said plurality of locking teeth has a substantially triangular with a narrow front part and a wide rear part, and a guiding inclined surface portion interconnects said front part with a locking end surface located upon said rear part.

4. The ring adjuster according to claim 2, wherein:

said lower surface portion of said main body comprises an adjusting outlet in communication with said second locking groove.

5. The ring adjuster according to claim 1, wherein:

said second opposite free end portion of said at least one locking belt comprises a guiding portion, wherein a width dimension of a rear end portion of said guiding portion is greater than a width dimension of a front end portion of said guiding portion.

6. The ring adjuster according to claim 1, wherein:

said adjuster main body, is made of flexible material;

said first end of said at least one locking belt and said lower surface portion of said main body are molded in one piece; and said plurality of locking teeth and said second free end of said at least one locking belt are molded in one piece.

7. The ring adjuster according to claim 1, wherein:

said at least one locking belt comprises at least two locking belts; and said at least two locking belts are spaced along a length direction of said adjuster main body.

* * * * *